United States Patent [19]

Yokoyama et al.

[11] Patent Number: 4,817,546

[45] Date of Patent: Apr. 4, 1989

[54] SHIRRING CONTROL APPARATUS AND METHOD

[75] Inventors: Taishi Yokoyama; Isao Takahashi; Masahiko Sato, all of Tokyo, Japan

[73] Assignee: Tokyo Juki Industrial Co., Ltd., Tokyo, Japan

[21] Appl. No.: 172,144

[22] Filed: Mar. 23, 1988

Related U.S. Application Data

[63] Continuation of Ser. No. 878,833, filed as PCT JP84/00510 on Oct. 25, 1984, published as WO86/02673 on May 9, 1986.

[51] Int. Cl.[4] ..... D05B 27/08

[52] U.S. Cl. ..... 112/262.1; 112/313; 112/315; 112/320; 112/121.11

[58] Field of Search ..... 112/313, 121.11, 121.12, 112/315, 320, 2, 262.1

[56] References Cited

U.S. PATENT DOCUMENTS

| | | | |
|---|---|---|---|
| 4,412,498 | 11/1983 | Scholl | 112/121.11 X |
| 4,429,364 | 1/1984 | Maruyama et al. | 112/121.11 X |
| 4,509,443 | 4/1985 | Martell et al. | 112/313 X |

FOREIGN PATENT DOCUMENTS

| | | | |
|---|---|---|---|
| 0124211 | 5/1987 | European Pat. Off. . | |
| 3032897C2 | 11/1983 | Fed. Rep. of Germany . | |
| 3046260C2 | 11/1983 | Fed. Rep. of Germany . | |
| 0238405 | 8/1986 | German Democratic Rep. | 112/121.11 |
| 47853 | 4/1976 | Japan . | |
| 132985 | 10/1981 | Japan . | |
| 44086 | 3/1983 | Japan . | |
| 55974 | 4/1984 | Japan . | |

*Primary Examiner*—Peter Nerbun

*Attorney, Agent, or Firm*—Tarolli, Sundheim & Covell

[57] ABSTRACT

A shirring control apparatus automatically reads sewing data from a pattern or the like, automatically calculates the sewing data from the read data or the data previously read from the pattern, distributes the amount of shirring for each of the desired areas of a circle of the sleeve from the calculated sewing data, controls the distributed amount of shirring for each stitch, changes the amount of shirring differentially dependent upon the quality of the cloth and the bias, and displays the differential movement.

9 Claims, 15 Drawing Sheets

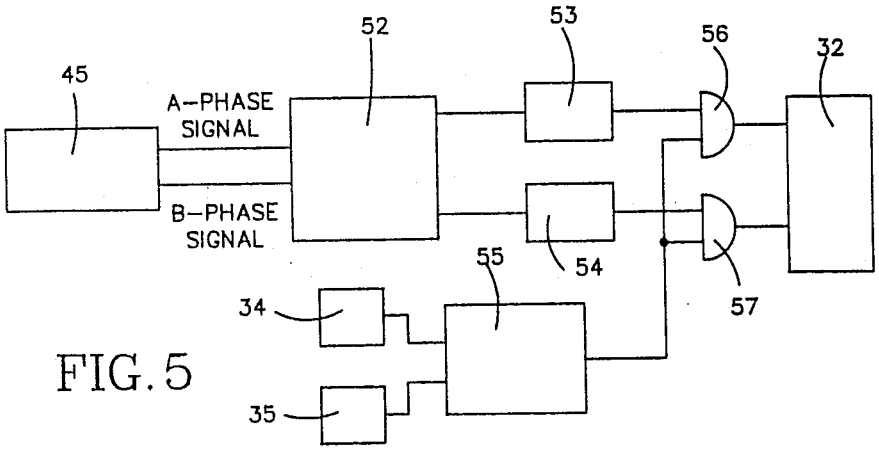
FIG. 5
FIG. 6
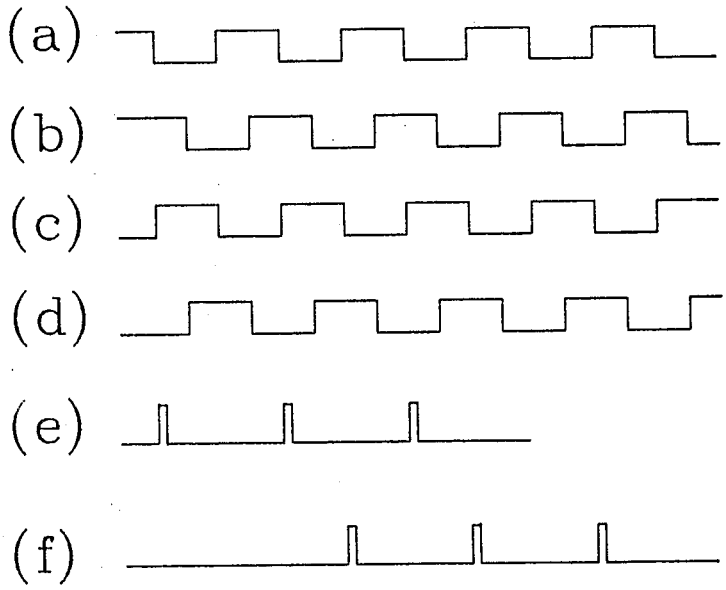

SHIRRING CONTROL APPARATUS AND METHOD

This is a continuation of copending application Ser. No 878,833 filed as PCT JP84/00510 on Oct. 25, 1984, published as WO86/02673 on May 9, 1986.

Technical Field

The present invention relates to an automatic shirring control apparatus combined with an automatic sewing length measuring apparatus in an automatic variable-shirring machine, for processing sewing data electrically loaded from patterns serving as basis and for correcting a differential movement in the amount of feed between upper feed teeth and lower feed teeth in correspondence to changes in easiness of shirring.

BACKGROUND ART

In a conventionally known shirring machine, in, for example, a sleeve shirring step, a sewing length is determined by manually measuring the circumference of an arm hole and the periphery of the sleeve separately, then the sewing length is divided into several portions to define sewing areas, number of stitches and amount of shirring from the start to end of sewing in correspondence to each sewing area of a work piece having these sewing areas are stored in a memory, the stored data are read in synchronism with the reciprocating motion of a sewing needle of the machine from the start to end of sewing, and the amount of shirring of the work feeder is changed according to the data read from the memory (Japanese Utility Model Public Disclosure No. 55974/84 Official Gazette).

However, the conventional shirring machine, in which the circumferences of the arm hole and the sleeve were measured separately by hand to determine the sewing length, had various disadvantages that troublesome operations and time consuming calculations were required to input the data such as the number of stitches and the amount of shirring to the memory, bulging at the upper end of the sleeve is made unnatural because the amount of shirring is uniform for each sewing area, much experience is necessary for making the data because the amount of shirring changes by the quality of the cloth and the cutting angle, and the quality of the finished product varies dependent upon the data made as described above.

Accordingly, an object of the present invention is to provide a shirring control apparatus adapted to automatically read sewing data (sewing length that is the number of stitches, and differential movement necessary to join a body cloth and a sleeve cloth) contained in a pattern.

Another object of the present invention is to provide a shirring control apparatus adapted to automatically calculate the sewing data from the data read automatically.

A further object of the present invention is to provide a shirring control apparatus adapted to divide the circumference of the sleeve into a desired number of areas from the calculated sewing data and to distribute the amount of shirring to the areas.

A further object of the present invention is to provide a shirring control apparatus adapted to control the amount of shirring in these areas for each stitch.

A further object of the present invention is to provide a shirring control apparatus adapted to adjust the amount of shirring controlled for each stitch by correcting the amount of the differential movement dependent upon the quality of the cloth and the bias.

A still further object of the present invention is to provide a shirring control apparatus adapted to display the amount of difference in the amount of feed between the upper feed teeth and the lower feed teeth in shirring.

DISCLOSURE OF INVENTION

The shirring control apparatus according to the present invention is adapted to automatically read sewing data from patterns, to automatically calculate the sewing data from the read data, to distribute the amount of shirring for each desired area of the circumference of the sleeve from the calculated sewing data, to control the distributed amount of shirring for each stitch, to change the amount of differential movement of the feed teeth depending upon the quality of the cloth and the bias, and to display the amount of the differential movement. Therefore, since the apparatus according to the present invention is capable of following the accuracy of the sewing machine regardless of the sewing length and area, it is made possible to effect shirring accurately as desired and to reduce the time of trial sewings, and since the apparatus is capable of accurately controlling the amount of shirring depending upon the quality of the cloth such, for example, as elasticity thereof, it is made possible to improve the sewing quality without relying upon the sixth sense of the operator. Further, since the apparatus according to the present invention is capable of coping with diversified sewing materials more flexibly than any of conventional apparatuses, it is made possible to effect sewing in the shape very close to the designer's idea and to proceed the know-how owned by a sewing factory from the individual worker level to the factory level, to thereby uniformalize and improve the sewing quality.

BRIEF DESCRIPTION OF DRAWINGS

The invention will be better understood from the following description taken in connection with the accompanying drawings in which:

FIG. 5 is a block diagram of the pattern reading device of FIG. 2;

FIG. 6 is a diagram of waveforms generated at various portions in the block diagram of the pattern reading apparatus of FIG. 5;

BEST MODE FOR CARRYING OUT THE INVENTION

The present invention will now be described in greater detail with reference to the drawings.

Figure 1:
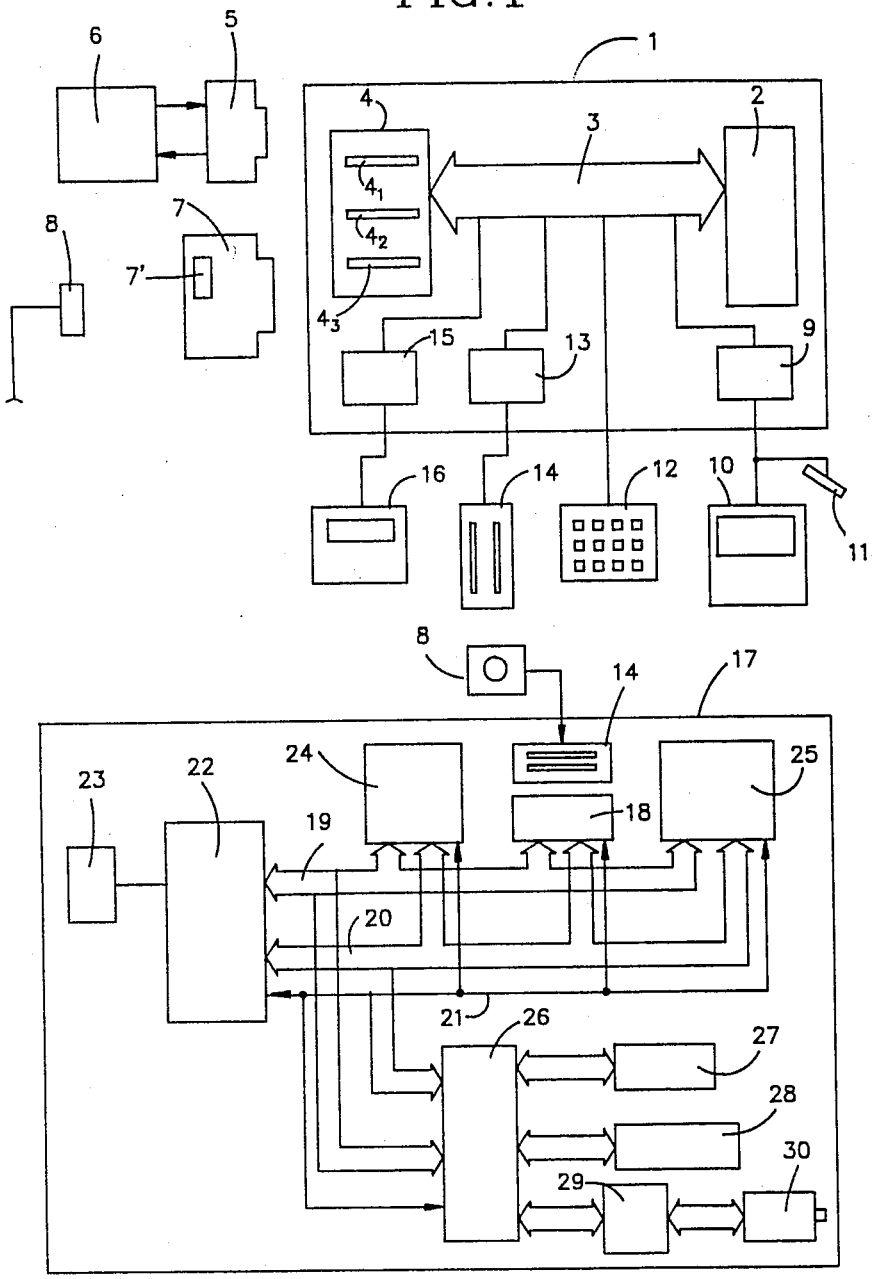
FIG. 1 is a block diagram of a shirring control apparatus according to the present invention.

In FIG. 1 showing a block diagram of the shirring control apparatus according to the present invention, the shirring control apparatus is divided into a data making device 1 and a machine side control device 17. The data making device 1 consists of a personal computer, in which an interface 4 having card slots $4_1$, $4_2$ and $4_3$ is connected to a CPU (Central Processing Unit) 2 through a data address control bus 3. Inserted into the card slot $4_1$ of the interface 4 is a pulse count interface board 5 to which a pattern input device 6 is connected. Inserted into the card slot $4_2$ is a RAM writing device 7 having a mount 7' to which a RAM card or floppy disk 8 storing the data made by the data making device 1 is removably attached. The RAM card or floppy disk 8 may be a PROM. Further connected to the data address control bus 3 are a monitor 10 and a light pen 11 through a graphic control video interface 9, a floppy disk device 14 through a keyboard 12 and a floppy disk interface 13, and a printer 16 through a printer interface 15, respectively.

While the RAM card or floppy disk 8 storing the data made by the data making device 1 of the construction described above is connected to the machine side control device 17, the floppy disk 8 is connected to an FDD controller 18 through the floppy disk driver 14, and the RAM card 8 is connected to a RAM socket 18. The RAM socket or FDD controller 18 is connected through an address bus 19, a data bus 20, and a control bus 21 to a CPU 22 to which an oscillator 23 is connected. Further connected to the address bus 19, the data bus 20 and the control bus 21 are a PROM 24, a RAM 25 and an interface 26 for a machine control program, respectively. A stepping motor 30 is connected to the interface 26 through an external display circuit 27, an external input switch 28, and a stepping motor control and driver circuit 29.

Figure 2:
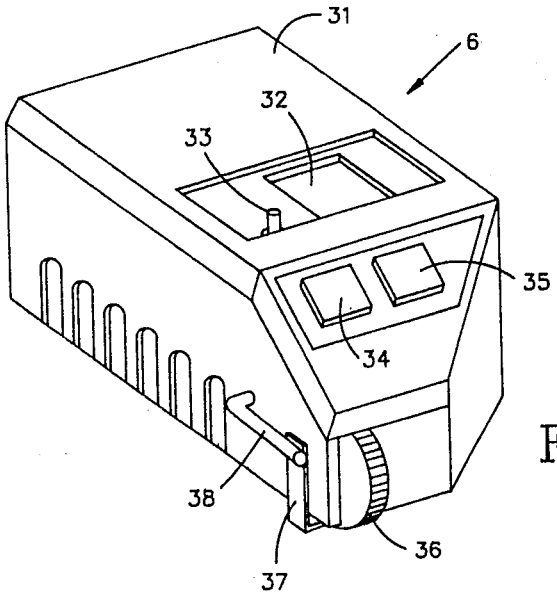
FIG. 2 is a perspective view of a pattern reading device for use with the shirring control apparatus of FIG. 1.
Figure 3:
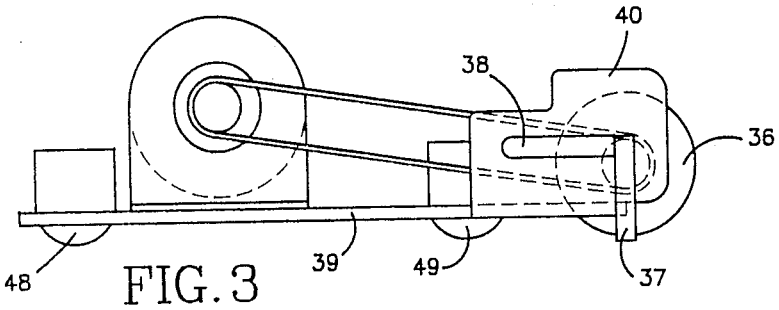
FIG. 3 is a side view of the pattern reading device of FIG. 2 with a cover taken away.
Figure 4:
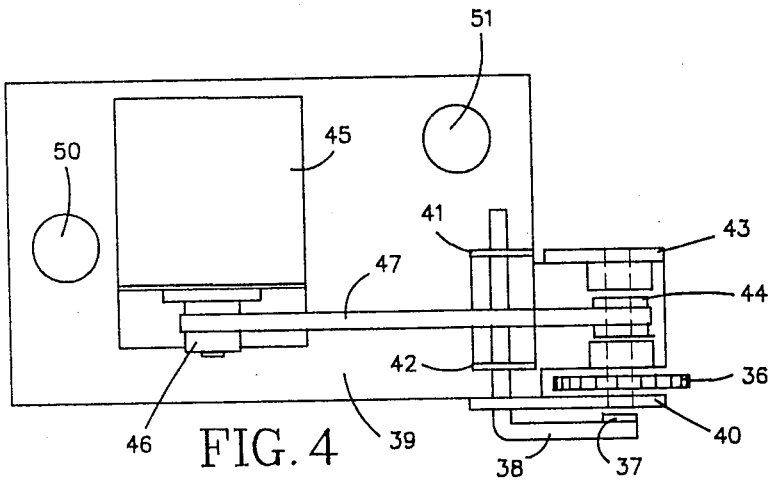
FIG. 4 is a plan view of the pattern reading device of FIG. 2 with the cover taken away.

FIGS. 2 to 4 are perspective, side and plan views, respectively, of the pattern input device 6 shown in FIG. 1. As shown in FIG. 2, the pattern input device 6 has a display unit 32 provided in the top surface of a case 31 thereof. The display unit 32 usually consists of a liquid crystal display means. Projected from the neighborhood of the display unit 32 is a reset switch 33 for resetting the display unit 32 to "0". A count start switch 34 and a count stop switch 35 are provided on the inclined portion of the top surface of the case 31 of the pattern input device 6. Further provided in the case 31 of the pattern input device 6 is a roller 36 projecting partially from the lower front portion of the case 31. The roller 36 is so constructed as to rotate on the pattern smoothly without slippage. Provided on a side of the roller 36 is a holder 37 allowing the roller 36 to move along a line spaced a given distance from an end of the pattern. The holder 37 is connected to a lever 38 which is retractable to change the distance between the holder 37 and the roller 36. The lever 38 is supported by frames 40, 41 and 42 provided on a chassis 39 as shown in FIGS. 3 and 4. A rotary shaft of the roller 36 is supported by the frame 40 and a frame 43. A timing belt 47 is disposed between a pulley 44 secured to the rotary shaft of the roller 36 and a pulley 46 of a pulse generator 45 consisting of an encoder secured to the chassis 39. The pulse generator 45 is constructed to generate, for example, 360 pulses for each rotation of the pulley or one pulse for each 0.2 mm advancement of the roller 36, to thereby convert the angle of rotation into pulses. Ball cases 50 and 51 having undirectionally rotatable balls 48 and 49 mounted therein, respectively, are secured at predetermined positions on the underside of the chassis 39 so as to allow the roller 36 to follow any shape of the pattern.

In the pattern input device 6, when the roller 36 rotates, as shown in FIG. 5, the pulse generator 45 generates an A-phase signal (advance signal) and a B-phase signal (delay signal) which are detected and decided by a direction of rotation detecting and deciding circuit 52, and a forward or reverse signal is generated from a forward pulse generator circuit 53 or a reverse pulse generator circuit 54 in response to a signal from the direction of rotation detecting and deciding circuit 52. Here, if the count start switch 34 is depressed and thereafter the count stop switch 35 is depressed, a start signal and a stop signal are outputted from a count start and stop signal output device 55 to turn on and off AND gates 56 and 57, whereby the length of the pattern passed by the roller 36 is detected by the output pulse which passed during the turning on and off of the AND gate 56 or 57 and is displayed by the display unit 32.

FIG. 6 provides diagrams of waveforms outputted by component parts of the pattern input device shown in FIG. 5, in which FIG. 6(*a*) shows the A-phase signal, FIG. 6(*b*) shows the B-phase signal, FIG. 6(*c*) shows an inverted signal C of the A-phase signal, FIG. 6(*d*) shows an inverted signal D of the B-phase signal, and FIG. 6(*e*) shows an AND signal between the pulse generated by falling of the A-phase signal and the B-phase signal, by which the rotation of the roller 36 is recognized to be forward. FIG. 6(*f*) shows an AND signal between the pulse generated by falling of the inverted signal C and the inverted signal D, by which the rotation of the roller 36 is recognized to be reverse. While this device has a disadvantage that the pulse is generated twice when the roller 36 is switched between forward and reverse, this can be neglected by increasing the distance accuracy per pulse.

Figure 7A:
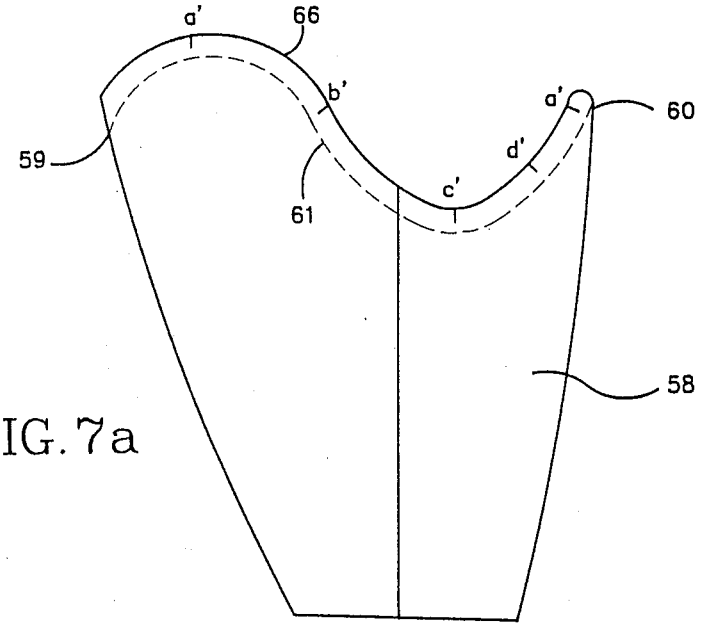
FIGS. 7A and 7B are a development of a sleeve piece and a body piece.
Figure 7B:
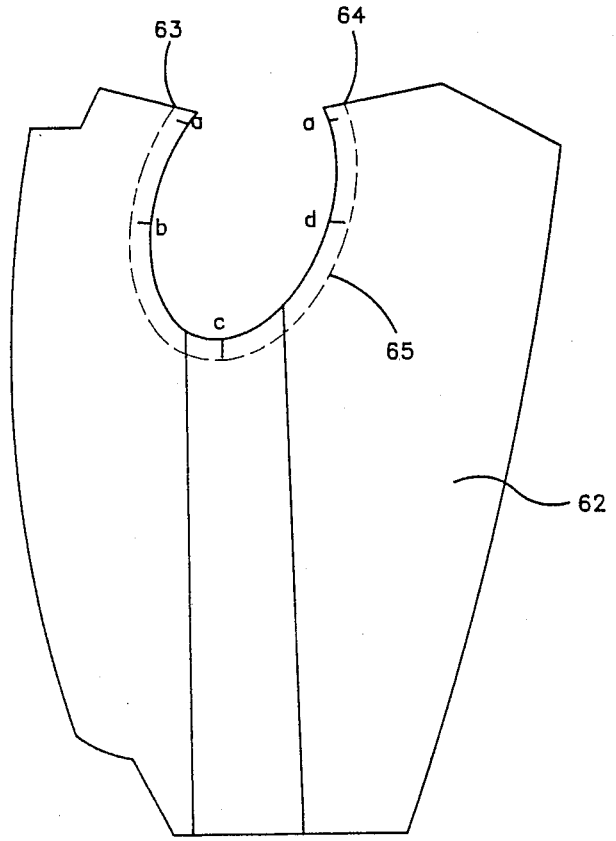
Figure 8A:
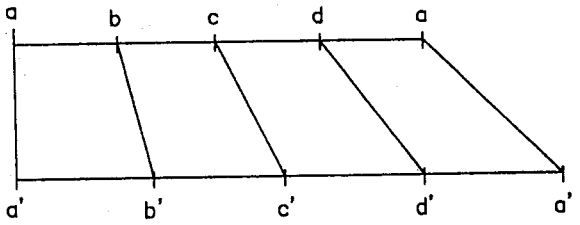
FIGS. 8A, 8B, 8C, and 8D are an illustration of distribution of the amount of shirring.
Figure 8B:
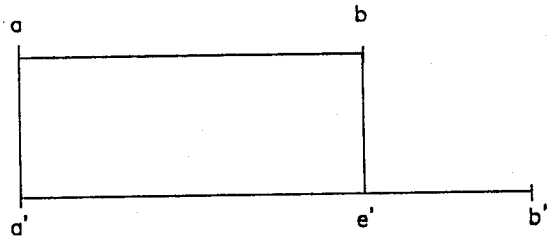
Figure 8C:
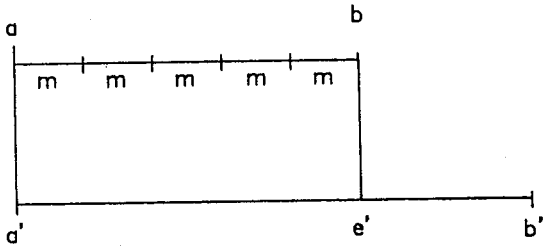
Figure 8D:
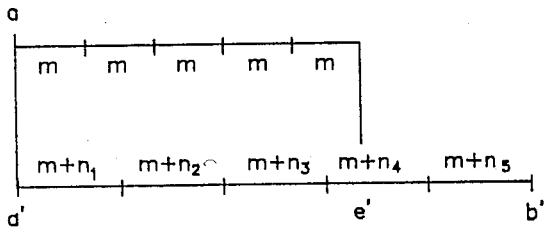

By moving the pattern input device 6 having the above-described construction along a stitch line 61 from a start point 59 to a stop point 60 of a sleeve pattern 58 shown in FIG. 7(*a*), the length of a sleeve cap line can be automatically measured. Likewise, by moving the pattern input device 6 along a stitch line 65 from a start point 63 to a stop point 64 of the arm hole of a body pattern 62 shown in FIG. 7(*b*), the length of the arm hole can be measured. In this manner, the data measured by the pattern input device 6 are inputted to the data making device shown in FIG. 1.

Since the length of the sleeve cap line 66 [see FIG. 7(*a*)] of the sleeve pattern 58 measured by the pattern input device 6 is larger than the arm hole 67 [see FIG. 7(*b*)] of the body pattern 62, if the sleeve cap line 66 made by the sleeve pattern 58 is joined to the arm hole 67 made by the body pattern 62, the sleeve cap line 66 will remain partly unjoined. Accordingly, by effecting differential movement to the sleeve cap line 66 so that the sleeve cap line 66 is shirred to be equal in length to the arm hole 67, the sleeve cap line 66 and the arm hole 67 can be sewed together in the same length. However, when the sleeve cap line 66 and the arm hole 67 are simply joined together, the alignment notches do not always agree. Accordingly, as shown in FIG. 7(*a*), shirring is effected with the sleeve cap line 66 shirred so that the notches a'-d' of the sleeve cap line 66 and the notches a-d of the arm hole 67 are aligned with each other. That is, the length of the arm hole 67 of the body and the length of the sleeve cap line 66 of the sleeve are shown as straight lines in FIG. 8(*a*). Here, let us take the section a-b of the arm hole 67 and the section a'-b' of the sleeve cap line 66 as shown in FIG. 8(*b*). If the length of the section a'-b' is l(a'-b') and the length of the section e'-b' is E(a-b), shirring of l(a'-b') by E(a-b) makes l(a'-b') equal to the length of the section a-b, that is l(a-b) of the arm hole 67 of the body, so that the section a'-b' of the shirred sleeve cap line 66 can be aligned with the section a-b of the arm hole 67. That is, $$l(a-b)=l(a'-b')-E(a-b).$$

Here, since a' is the alignment notch of the arm top, the shirring is desirably more in the neighborhood of a' than in the neighborhood of b'. For this purpose, the section a-b is divided into five subsections and more amount of shirring is distributed toward a. That is, if the section a-b of the body is divided into five subsections as shown in FIG. 8(*c*), the value m of each subsection is:

$$m=l(a-b)/5.$$

If the amount of shirring E(a-b) is distributed to the subsections m are $n_1$, $n_2$, $n_3$, $n_4$ and $n_5$, respectively, then, $$E(a-b)=n_1+n_2+n_3+n_4+n_5$$

$$\begin{aligned} l(a'-b') &= (m+n_1)+(m+n_2)+(m+n_3)+ \\ &\quad (m+n_4)+(m+n_5) \\ &= 5m+(n_1+n_2+n_3+n_4+n_5) \\ &= l(a-b)+E(a-b). \end{aligned}$$

That is, as shown in FIG. 8(*d*), the section a'-b' of the sleeve cap line is divided into five subsections to each of which the amount of shirring is distributed as $(m+n_1)$, $(m+n_2)$, $(m+n_3)$, $(m+n_4)$ and $(m+n_5)$, respectively. Since each of the five subsections $(m+n_1)$, $(m+n_2)$, $(m+n_3)$, $(m+n_4)$ and $(m+n_5)$ consists of a pularlity of stitches, the amount of shirring $n_1$, $n_2$, . . . $n_5$ distributed to these subsections, respectively, are uniformly subdivided and distributed to the stitches in each corresponding subsections so as to approach the ideal curve A shown in FIG. 9. That is, the distributed amount of shirring is larger as it approaches the arm top. By repeating the above-described operation for each of other sections b-c, c-d, and d-a, the amount of shirring can be determined for all the sections.

Tables 1 and 2 show examples of numerical values of the sleeve cap line and the body in actual operation. In the case where the length of each of the sections a'-b', b'-c', c'-d', and d'-a' of the sleeve cap line shown in FIG. 7(*a*) is 120 mm and each of the section a-b, b-c, c-d, and d-a of the arm hole of the body shown in FIG. 7(*b*) is 100 mm, the amount of shirring for each section is 20 mm.

TABLE 1

(unit: mm)

| Section | Notch a - b | b - c | c - d | d - a | Total |
|---|---|---|---|---|---|
| Sleeve Cap Line | 120 | 120 | 120 | 120 | 480 |
| Body | 100 | 100 | 100 | 100 | 400 |
| Amount of Shirring | 20 | 20 | 20 | 20 | 80 |

Here, in order to divide the section a-b into five subsections and to distribute the amount of shirring to each of them, the body of 100 mm is divided into five subsections [1]-[5] of 20 mm each and the amount of shirring of 20 mm is distributed to these five subsections [1]-[5] in 3 mm, 3 mm, 3 mm, 4 mm and 7 mm, respectively, to make the subsections [1]-[5] of the sleeve cap line 23 mm, 23 mm, 23 mm, 24 mm and 27 mm, respectively, as shown in Table 2.

TABLE 2

(unit: mm)

| Notch Section (a - b) | Body 100 mm in total | Amount of Shirring 20 mm in total | Sleeve Cap Line 120 mm in total |
|---|---|---|---|
| Subsection [1] | 20 | 3 | 23 |
| Subsection [2] | 20 | 3 | 23 |
| Subsection [3] | 20 | 3 | 23 |
| Subsection [4] | 20 | 4 | 24 |
| Subsection [5] | 20 | 7 | 27 |

While the length of the sleeve cap line can be agreed with the length of the arm hole of the body by distributing the amount of shirring amount the sections of the sleeve cap line and the arm hole of the body as described above, the bulging of the arm top cannot be made neatly by simply distributing the amount of shirring among the sections uniformly. Accordingly, as shown by a curve A in FIG. 9, the sleeve cap line is shirred much in the neighborhood of the arm top and little in the neighborhood of the foot. In other words, the amount of shirring is distributed by operation along the curve A of FIG. 9 so as to effect much shirring in the portion a' and little shirring in the portion c' of FIG. 7(*a*).

Figure 9:
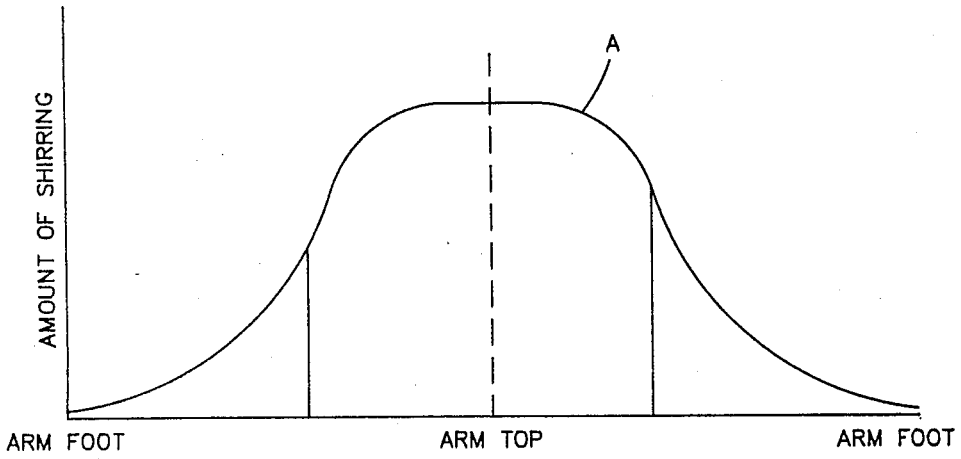
FIG. 9 is an ideal distribution curve for distributing the amount of shirring among the areas.

Even when the sleeve cap line and the arm hole of the body are divided into uniform sections, respectively, the amount of shirring in each of the sections is calculated according to the curve A of FIG. 9, and the differential movement in the amount of feed between the upper feed teeth and the lower feed teeth is determined to obtain the desired amount of shirring for a certain kind of cloth, the desired amount of shirring cannot be obtained for a different kind of cloth by the differential movement determined as described above. Further, even when the differential movement remains unchanged, the amount of shirring changes as the sewing angle for bias changes, and the way of change of the sewing angle for bias and the easiness of shirring changes from a kind of cloth to another kind of it . In brief, there is no rule or regularity for the way of change of the amount of shirring. Conventionally, therefore, the difference in the easiness of shirring due to the difference in the kind of cloth was neglected, the data on the differential movement were made for a specified kind of cloth and different data were made for another kind of cloth, or the easiness of shirring was decided visually or empirically and the differential movement was determined in accordance with the data based on the decision.

Figure 10:
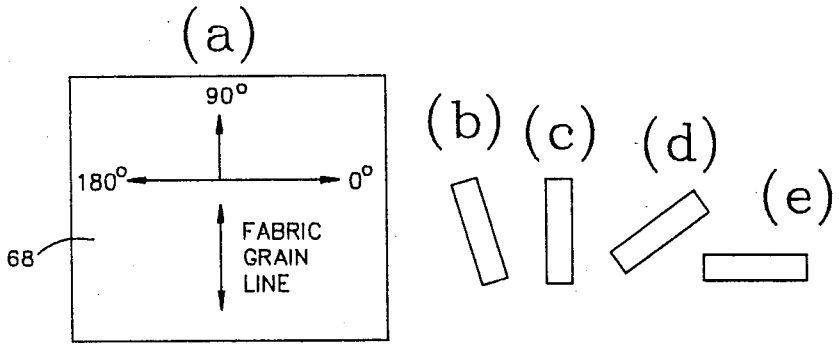
FIG. 10 is an illustration of cutting angle with respect to the fabric grain line.

In the present invention, therefore, data on the easiness of shirring are collected experimentally for various kinds of cloth in a given format, the data so obtained are processed by the computer, translated into intermediate codes which are stored in media such as floppy disk to form a random access file, and the easiness of shirring of a cloth is outputted by inputting the registration number and the sewing angle for the fabric grain line of the cloth as keywords. That is, as shown in FIG. 10(*a*), a cloth 68 is cut at the angles of, for example, 120°, 90°, 45° and 0° with respect to the frabic grain line of the cloth 68 as shown in FIGS. 10(*b*), 10(*c*), 10(*d*) and 10(*e*), respectively. The narrower the cutting angle is, the denser the data become. By actually sewing with the specified number of stitches (for example, 100 stitches) or the specified sewing length (for example, 20 cm) predetermined for each automatic shirring machine and with the predetermined differential movement, the finished size is measured. By dividing the finished size by the specified number of stitches, the amount of shirring per stitch is calculated. Further, by dividing (the specified length—the finished length) by the specified length, the finished size per unit length (coefficient K) is calculated. That is, the length of cloth×K=the amount of shirring.

By inputting the data obtained in this way by the keyboard 12 of FIG. 1, the CPU processes the data and makes a random access file which is stored in a floppy disk from the floppy disk device 14 of FIG. 1.

To fetch the data from the floppy disk, the cloth number and the angle with respect to the fabric grain line are inputted as keywords. Then, the amount of shirring per stitch (mm) and the finished size per unit length are outputted, to thereby obtain the desired amount of shirring.

By processing the input data as described above, the amount of shirring per stitch in each section of the sleeve cap line is determined, and the data are stored in the RAM card or floppy disk 8 attached to the mount 7' of the RAM writing device. These operations will now be described with reference to the flow charts of FIGS. 11 to 16.

Figure 11:
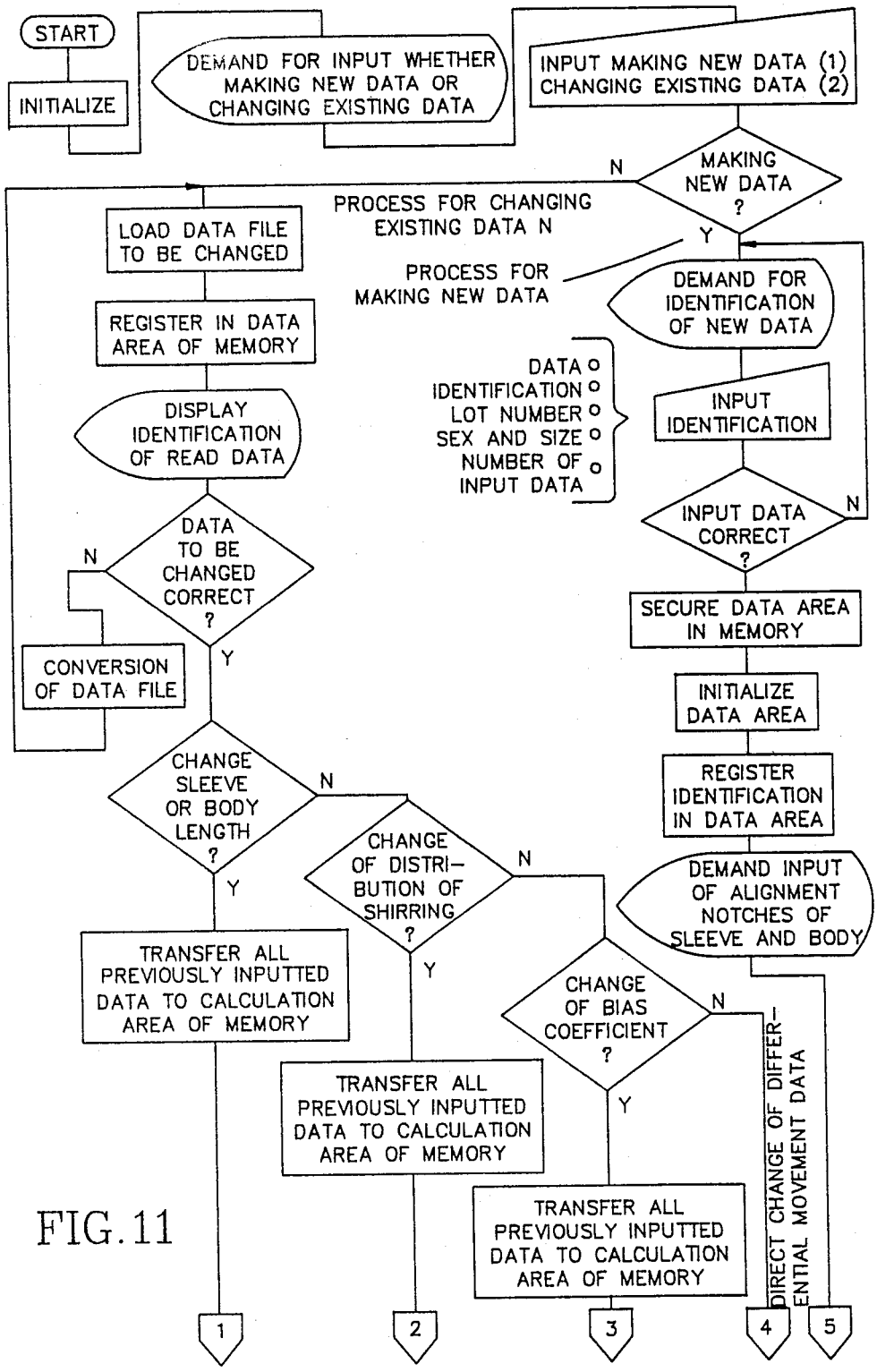
FIGS. 11 to 16 are flow charts of the data making device of the shirring control apparatus of FIG. 1.
Figure 12:
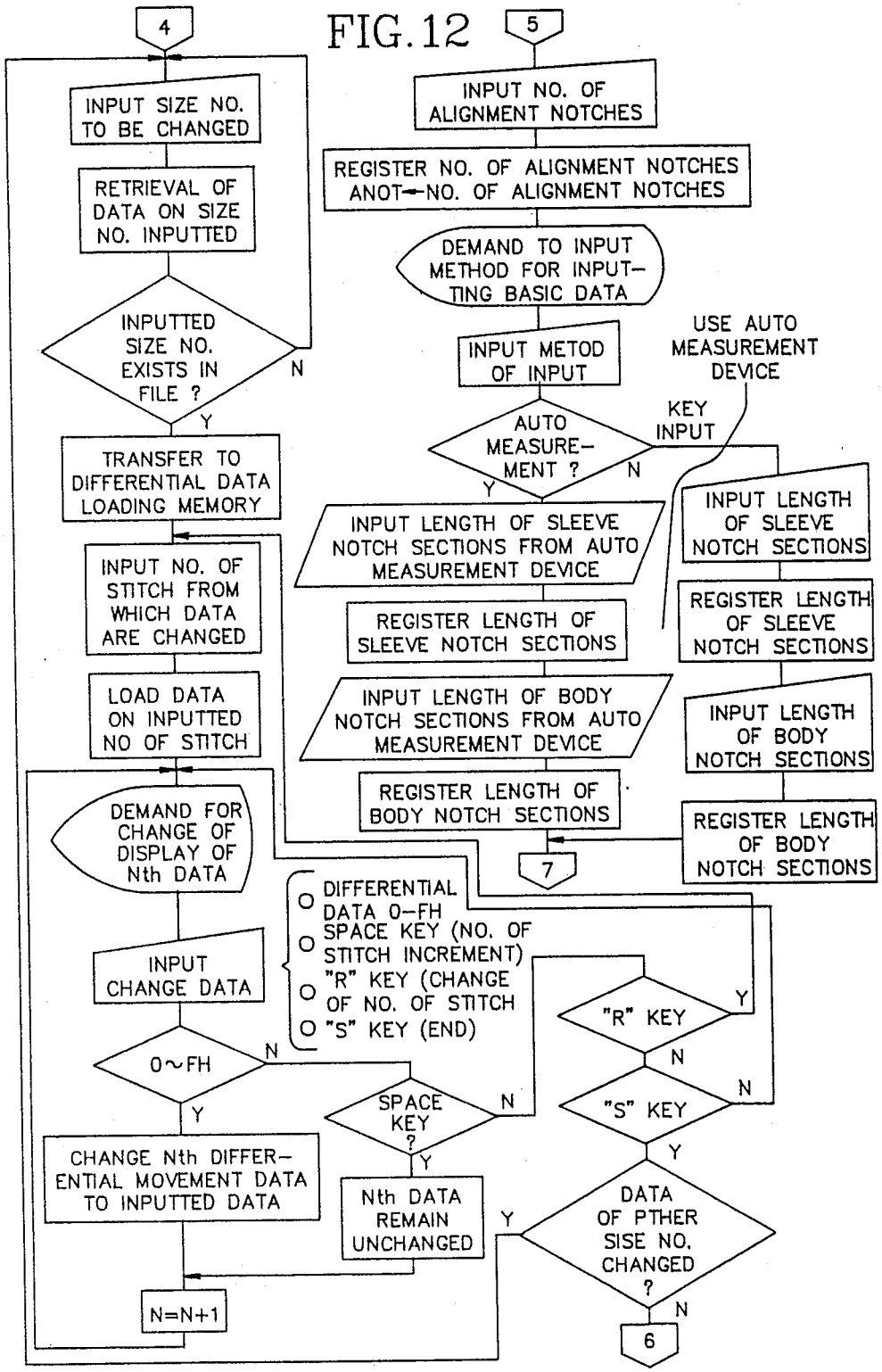

In FIG. 11, when the main switch is turned on, the apparatus is initialized to display in the monitor 10 of FIG. 1 whether it is to make new data or to change the existing data. In case of making the new data numeral "1" is inputted through the keyboard 12 and in case of changing the existing data numeral "2" is inputted through the keyboard 12. Then, in case of making the new data, identification of the new data is displayed in the monitor, and the date, name, Lot number, distinction of sex, and identification number of the clothes are inputted as the identification through the keyboard 12. If the input data are correct, a data area is secured in the memory of the data making device 1 of FIG. 1 in which the identification is registered. Then, since the requirement for the number of the alignment notches in the sleeve and the body is displayed in the monitor 10, the number of the alignment notches is inputted through the keyboard 12 in FIG. 12 to register it in the memory.

Thereafter, the basic data are required to be demanded. In reply to this, it is inputted through the keyboard whether the pattern is inputted by the pattern input device 6 shown in FIGS. 2 to 5 or the premeasured data are inputted. In case of inputting through the pattern input device 6, by moving the pattern input device 6 along the sleeve cap line of the pattern of the sleeve the length of each of sections between the notches is inputted and registered. Likewise, the length of each of sections between the notches of the arm hole of the body pattern is measured, inputted and registered.

Figure 13:
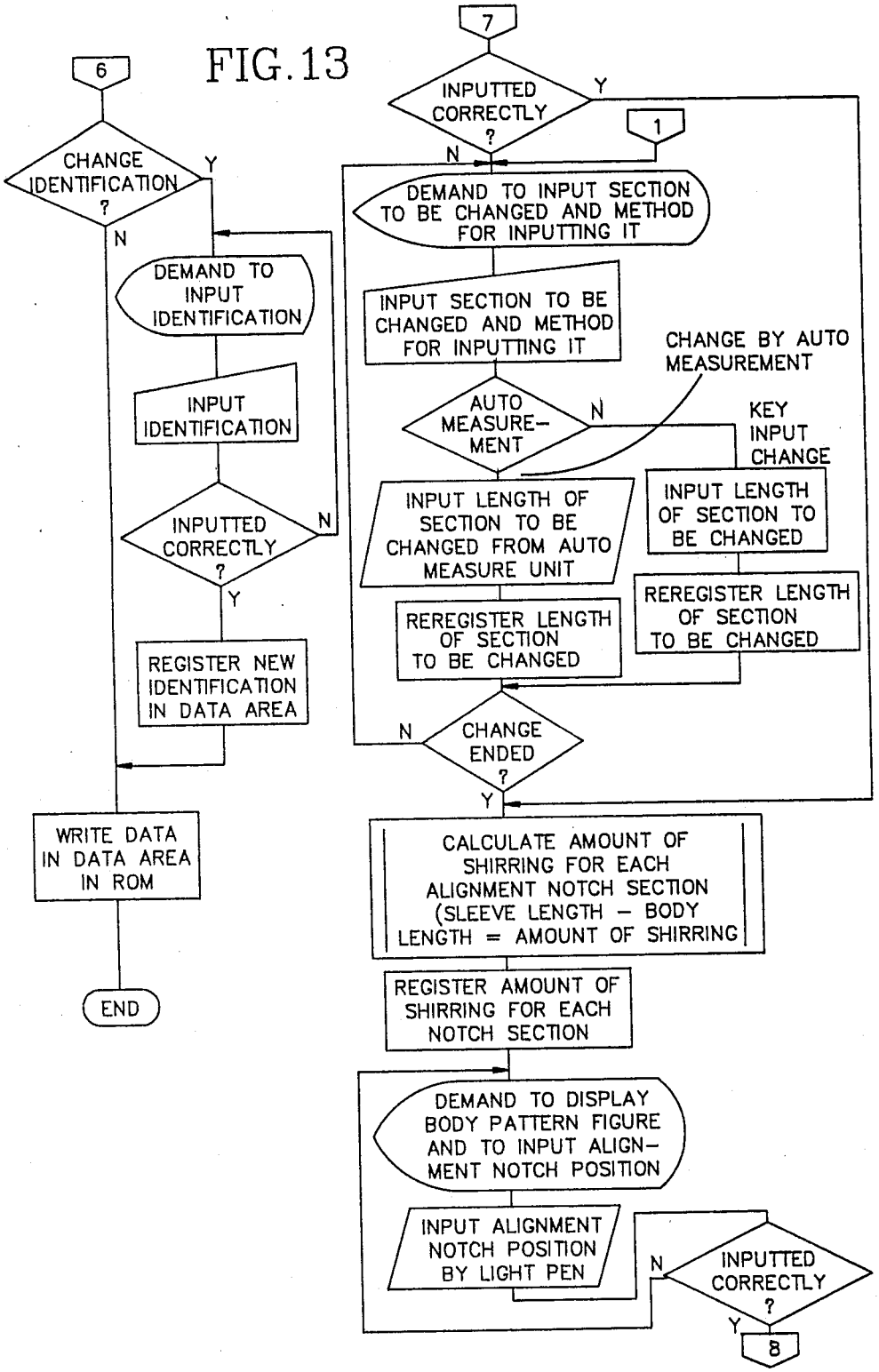
Figure 14:
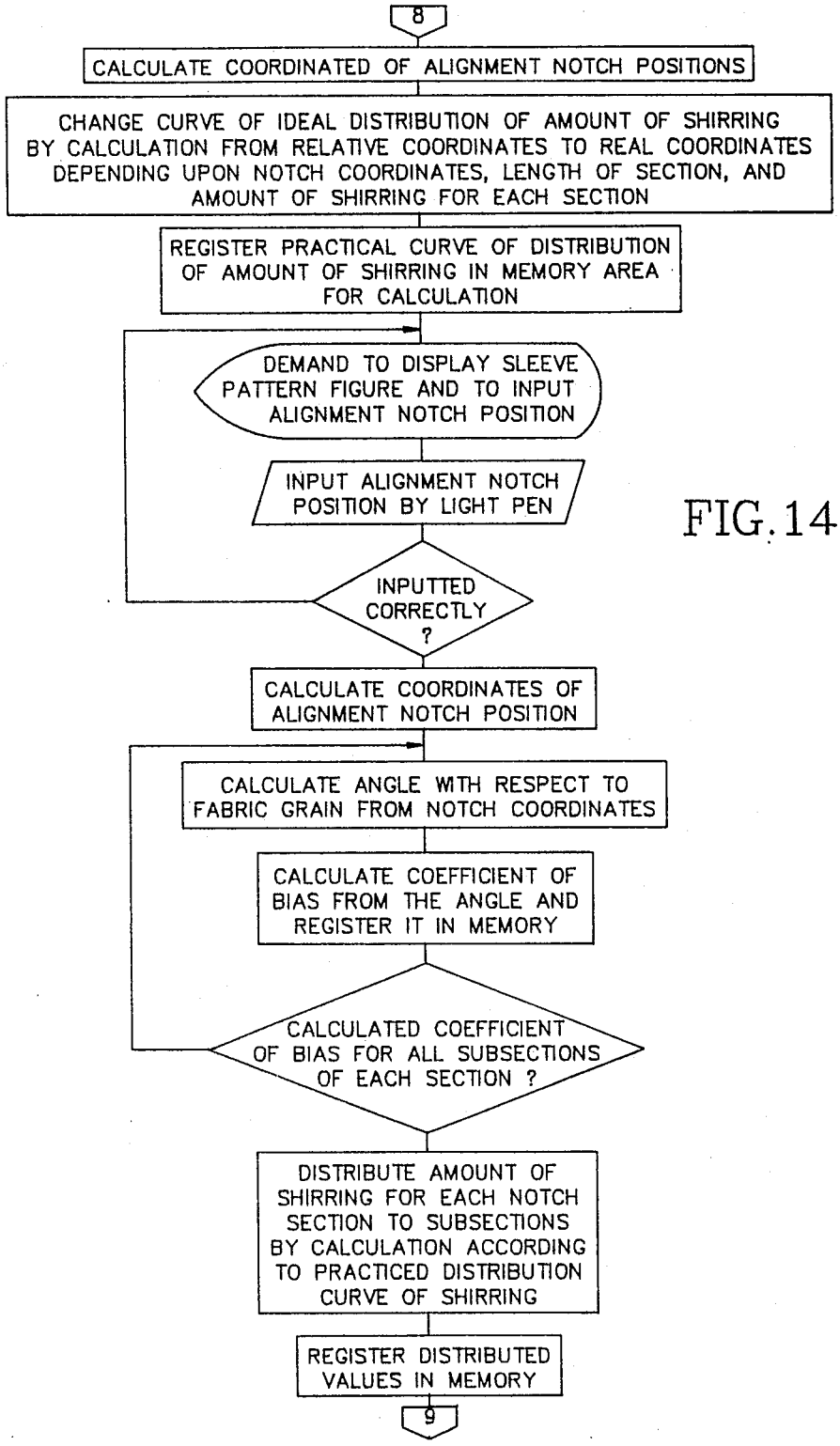

Here, if the basic data are not inputted correctly, it is demanded whether there is a section to be changed in FIG. 13. The data of this section to be changed are inputted by the pattern input device 6 or the keyboard 12. When this input is finished, the amount of shirring per alignment section is calculated and the amount of shirring per notch section is registered. Here, since the alignment between the notch positions of the body pattern and the notch positions of the figure displayed in the monitor is demanded, when an input is made by the light pen 11 to the figure displayed in the monitor 10, then the coordinate of the alignment notch position is calculated as shown in FIG. 14, the ideal distribution curve of the amount of shirring described with reference to FIG. 9 is changed by calculation from the relative coordinate to the al coordinate on the basis of the notch coordinate, the length of section and the amount of shirring of the section, and the distribution curve of the amount of shirring expressed in real values is registered in the memory area for calculation.

Likewise, since the alignment between the notch position of the sleeve pattern and the notch positions of the figure displayed in the monitor 10 is demanded, when the notch positions are inputted by the light pen 11, then the alignment notch positions are calculated, angles at the five-divided points of each notch section are calculated from the notch coordinate, and the coefficients of bias are calculated from the angles and registered in the memory. When the bias is calculated for all the divisions of each section, the amount of shirring is distributed to each notch section on the basis of the distribution curve of the amount of shirring and registered in the memory.

Figure 15:
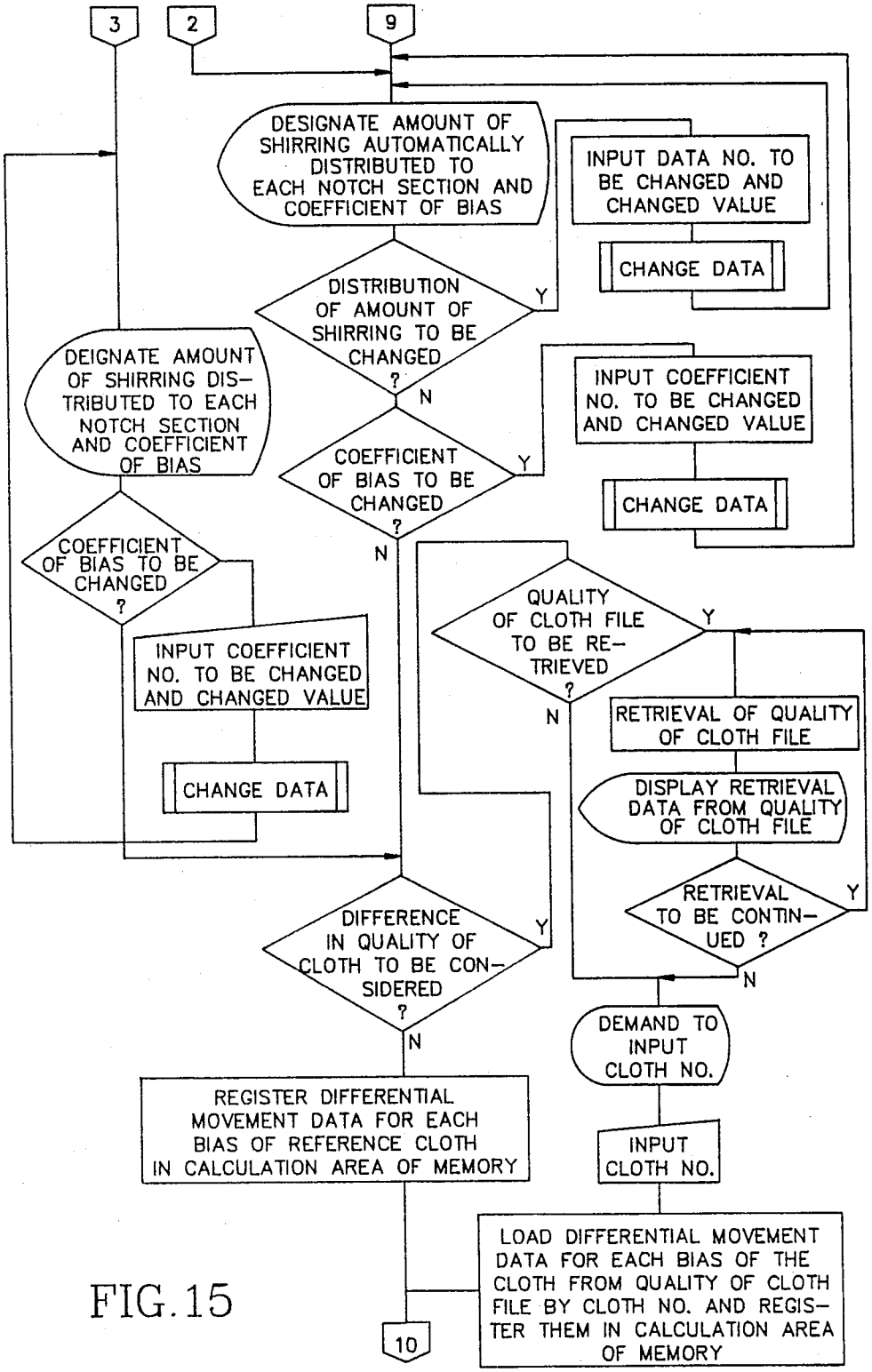
Figure 16:
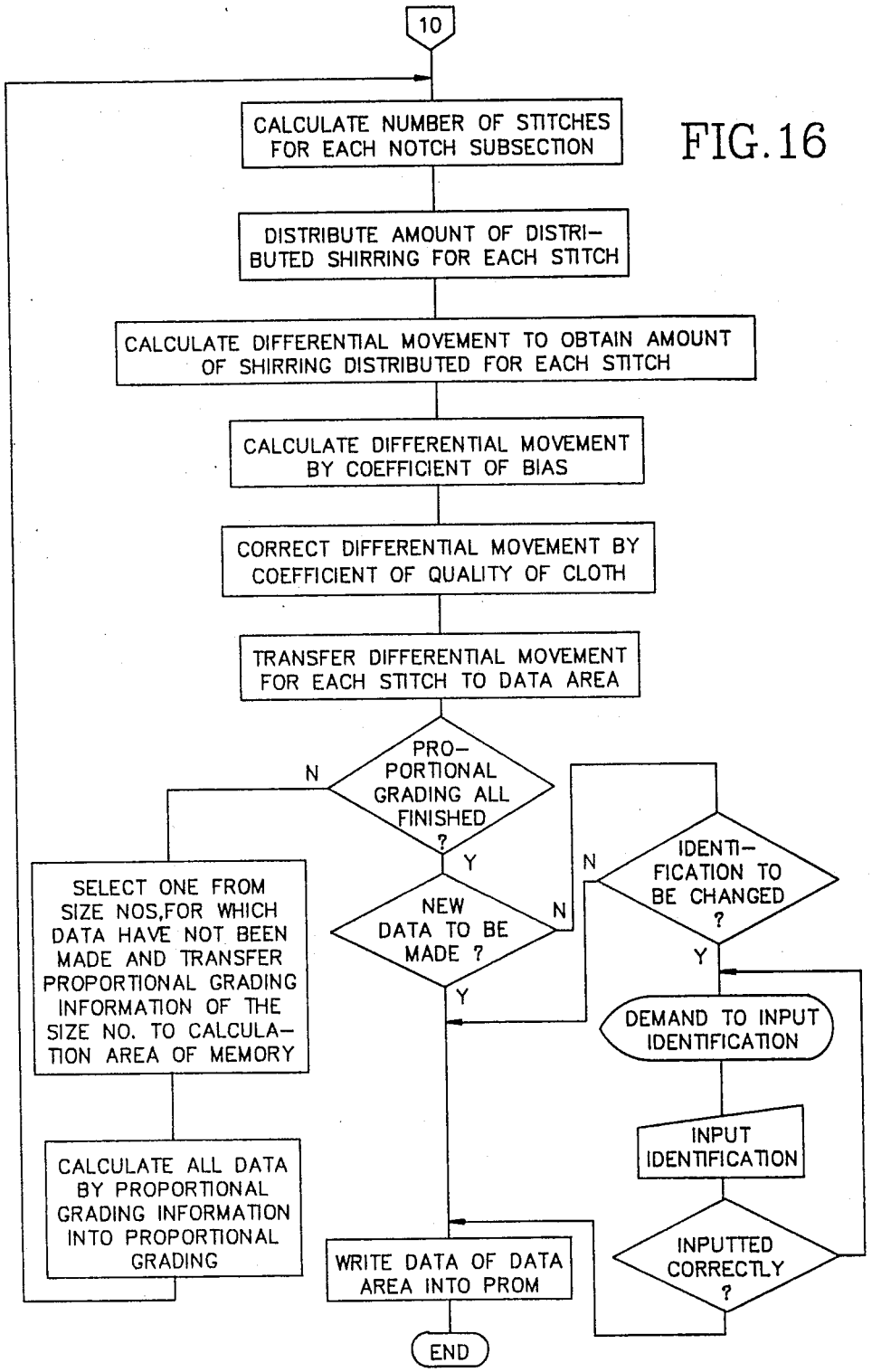

Then, in FIG. 15, since the automatic distribution of the amount of shirring between the notches and the coefficient of bias are displayed in the monitor 10, it is decided viewing the display in the monitor whether the amount of shirring or the coefficient of bias is changed or not. Then, it is demanded whether the difference in the quality of the cloth should be considered or not. In the case where the quality of the cloth is not considered, the data of differential movement for each bias of the reference cloth are registered in the calculation area of the memory. In the case where the quality of the cloth is considered, the data of the quality of cloth file explained with reference to FIG. 10 are displayed when the data on the quality of cloth are retrieved from the quality of cloth file, and when the cloth number is inputted according to the displayed data, the differential movement data per bias of the cloth are loaded from the quality of cloth file and registered in the calculation area of the memory.

On the basis of the differential movement data registered in the memory, the number of stitches per notch section is calculated, the amount of shirring is distributed for each stitch, the amount of differential movement to obtain the amount of shirring distributed for each stitch is calculated by means of the coefficient of bias and the coefficient of the quality of cloth, and the differential movement data per stitch is transferred to the data area.

Since the differential movement data calculated here are done so for one of the size numbers of the clothes for which the data have not been made, the data have not been calculated yet for other size numbers of the clothes. In order to obtain data for other size numbers of the clothes, accordingly, proportional grading information for these size numbers is inputted and transferred to the calculating area of the memory to calculate all the data and the differential movement data for all these size numbers of the clothes. These differential movement data calculated in this way are, if new data, written in the RAM card or floppy disk 8 attached to the mount 7' of the RAM writing device 7 inserted into the card slot $4_2$ of the interface 4.

Returning now to FIG. 11, in the case of changing the existing data, the data file to be changed is loaded and registered in the data area of the memory. The identification of the loaded file is displayed for confirmation. If confirmed, whether it is to change the length of the sleeve or the body, the distribution of the amount of shirring, or the coefficient of bias is demanded and the data previously inputted are transferred to the calculation area of the memory according to the object of the change. Here, in case of the change of the length of the sleeve or the body, the operation is transferred to the flow "1" in the chart of FIG. 13 and carried out as described above. In case of the change of the amount of shirring, the operation is transferred to the flow "2" in the chart of FIG. 15 and carried out as described above. Further, in case of the change of the coefficient of bias, the operation is transferred to the flow "3" in the chart of FIG. 15. In this case, the change of the data is carried out when the amount of shirring distributed to each section between the notches and the coefficient of bias are displayed and the number of the coefficient of bias to be changed is inputted.

In the case of direct change of the differential movement data, when the size number of the clothes to be changes is inputted, the inputted size number of the clothes is retrieved and transferred to the differential movement data reading memory. When the number of the stitch at which the change is effected is inputted, the data of the inputted number of the stitch is loaded. Then, the change of the Nth data is demanded and when the change data are inputted, the Nth differential movement data among the differential movement data O−FH are changed to the inputted data. When inputted by the space key, the Nth data remain unchanged and the operation is transferred to the change of the n+1th differential movement data. Further, when the space key is depressed and then the "R" key is depressed, the change of the number of stitches is started, and when the space key is depressed it is finished. In the case where other size numbers of the clothes should remain unchanged, the operation is transferred to the flow "6" in the chart of FIG. 13, in which the change of the identification is demanded, but if not changed, the data in the data area are written in the RAM card or floppy disk 8. In the case of change of the identification, a new identification is registered in the data area and written in the RAM card or floppy disk 8.

Figure 17:
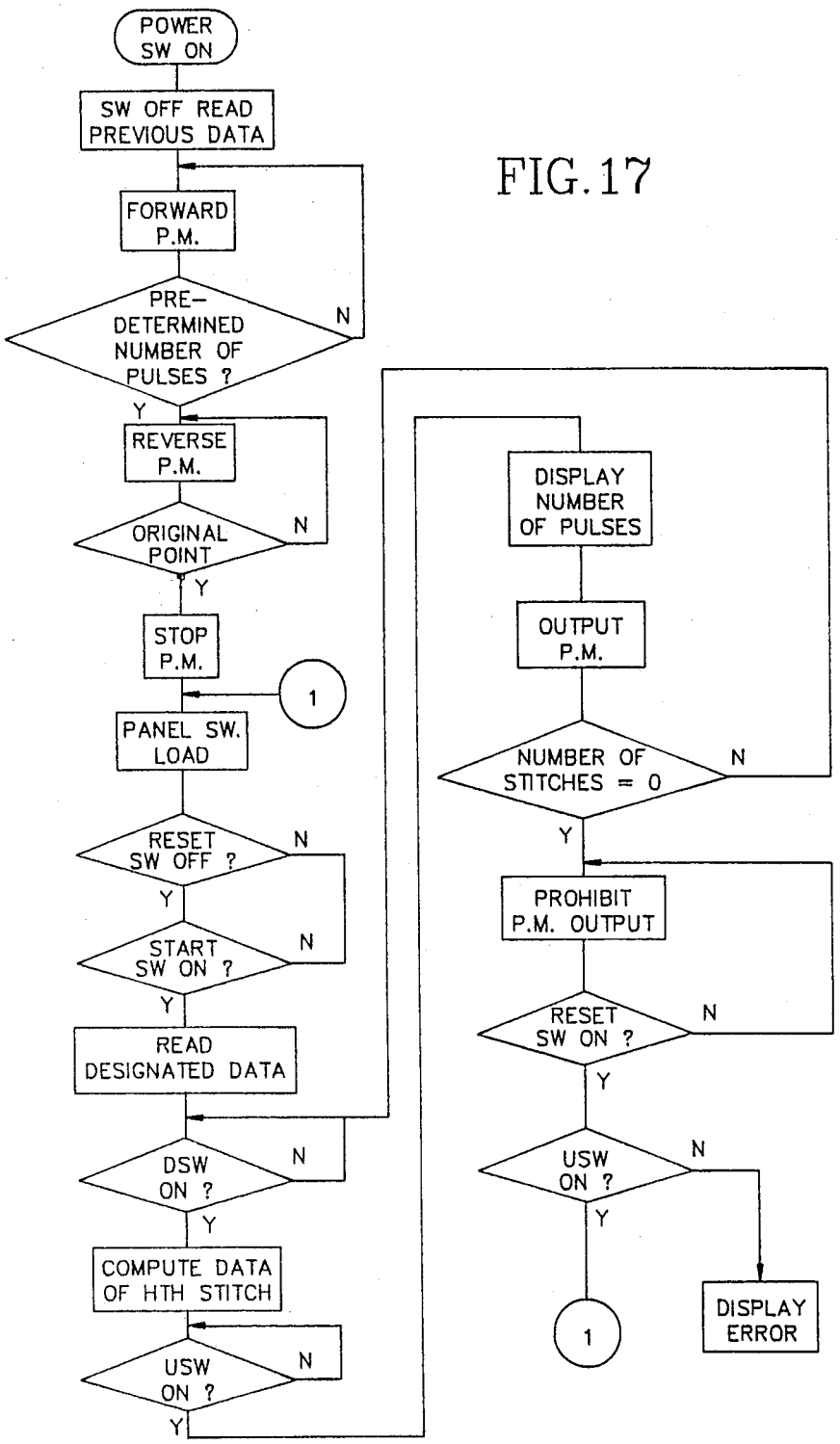
FIG. 17 is a flow chart of the machine side control device of FIG. 1.
Figure 18:
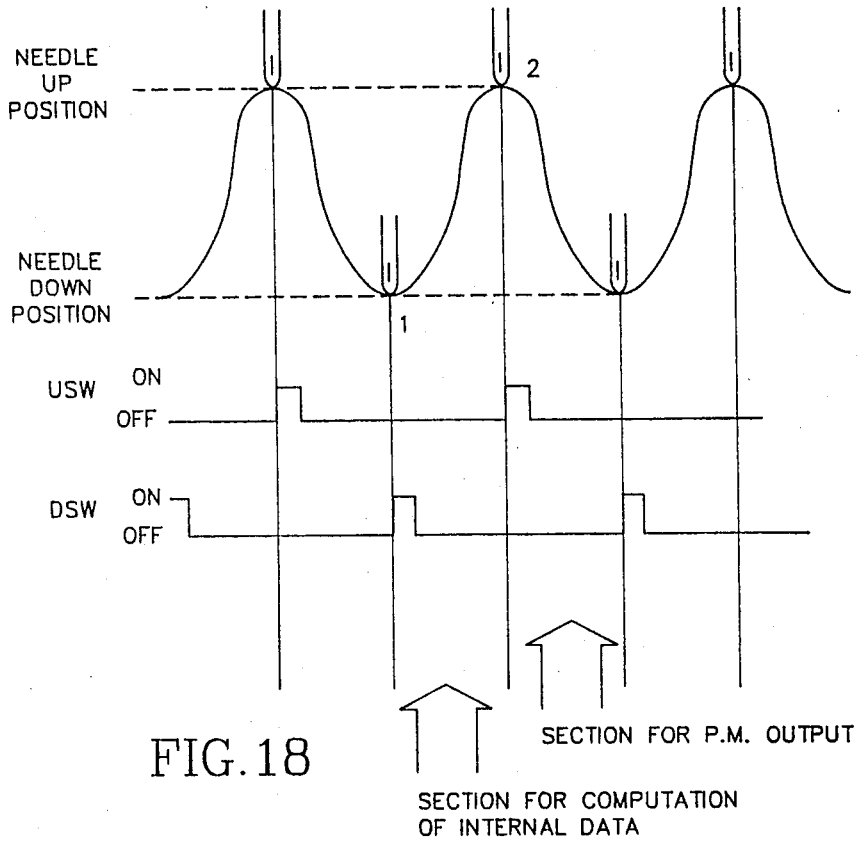
FIG. 18 is an illustration of the relation between the position of the needle and the switch for detecting the position.

As described above, the RAM card or floppy disk 8 on which the differential movement data are written is connected to the FDD controller 18 through the RAM socket 18 of the machine side control device 17 or the floppy disk driver 14 shown in FIG. 1. Here, the supply switch of the machine side control device 17 is turned on, the routine shown in FIG. 17 is performed. That is, when the supply switch is turned on, the data stored before the switch was previously turned off are read out to rotate the pulse motor 30 forward. When the pulse motor 30 is rotated for a predetermined number of pulses, the pulse motor 30 is rotated reversely to the original position to finish the initial routine upon turning on the power source. Then, the flow proceeds with the panel reading routine in which the position of the panel switch is loaded and whether the reset switch is on or the start switch is on is loaded. Further, the differential movement data described above are loaded from the RAM card or floppy disk 8. Then, the flow proceeds with the shirring execution routine by the sewing data. Here, in this shirring execution routine, as shown in FIG. 18, the fact that the needle rod comes to a lower stop portion ① is detected by a down switch DSW and compared with the data a stitch earlier, and whether the subfeed ratio is changed or not is calculated, and the fact that the needle rod comes to an upper stop position ② is detected by an upper switch USW to output the required pulses to move the pulse motor 30 to thereby move the differential shaft mechanism to effect shirring. Since "00" is placed in the data for the first stitch, detection begins with the second needle lower position. In this manner, the amount of shirring is calculated for each stitch and outputted. When the number of stitches becomes "0", the flow proceeds with the end confirmation routine in which output of the pulse motor is prohibited, whether the reset switch is on or not is confirmed, further whether the upper switch USW is on or not is detected, and if it is on, the flow returns to the loading rountine "1". If the upper switch USW is not on, an error is displayed. In the sewing machine according to the present invention, therefore, the needle is always on the upper switch side when the operation is finished.

Conventionally, shirring was controlled by deciding a section and deciding the amount of shirring in the section (for example, when the sewing section of 10 mm and the amount of shirring of 2 mm were determined, the shirring of 2 mm was effected in the sewing section of 10 mm). Therefore, it was difficult to increase the shirring accuracy in the conventional shirring control. In the present invention, however, by controlling the amount of shirring for each stitch it is made possible to follow the accuracy of the sewing machine irrespective of the section of the sewing length (since the differential movement can be changed for each stitch). Accordingly, the present invention provides such advantages that the shirring can be effected accurately as initially desired, the number of trial sewings can be reduced, the amount of shirring can be accurately controlled according to the elasticity of the cloth, and, therefore, the sewing quality can be increased irrespective of the operator's experience or sixth sense.

Further, the present invention is capable of coping with the more and more diversified sewing materials much more flexibly than the conventional means, the present invention provides such advantages that the sewing closer to the ideal form of the designer is made possible, and the know-how owned by a sewing factory can be transferred from the individual level to the entire factory level, to thereby equalize and improve the sewing quality.

While the above embodiment has been described to utilize a stepping motor as a drive unit, other motors having servo means or fine adjustment air cylinders may be utilized if they are controllable with fine angle.

Figure 19:
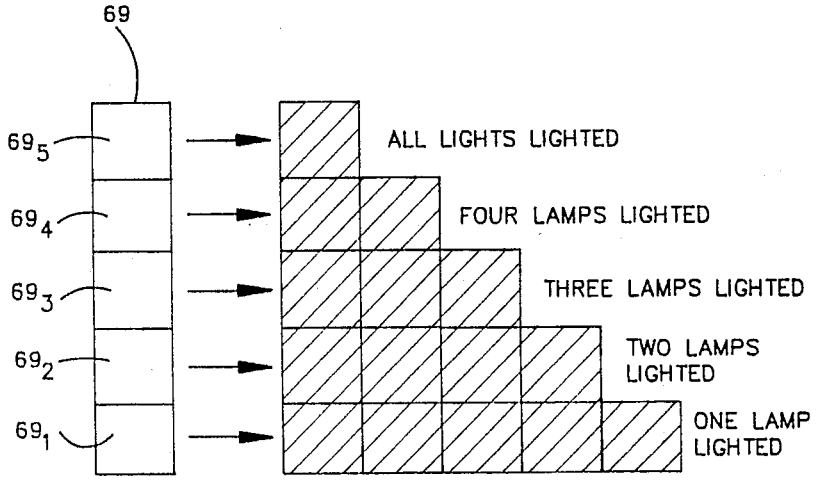
FIG. 19 is an illustration of lighting of lamps for indicating the amount of differential movement.
Figure 20:
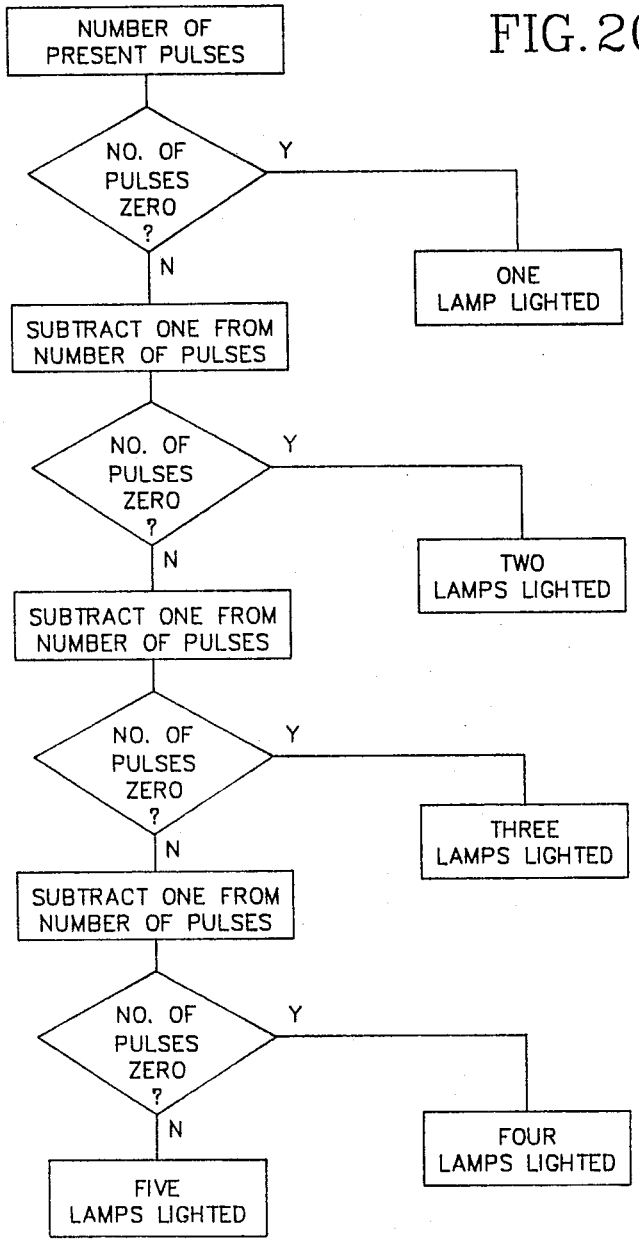
FIG. 20 is a flow chart for lighting the lamps of FIG. 19.

In the sewing machine of the type in which the differential movement between the upper feed teeth and the lower feed teeth is effected sequentially from the position "0", the fact that the amount of the differential movement determined by the program is not displayed gives uneasiness to the operator. In the present invention, accordingly, the position of the amount of the differential movement relative to the point of the origin is displayed by, for example, five lamps $69_1$–$69_5$ as shown in FIG. 19. In the routine for this display, as shown in FIG. 20, the number of the present pulses is detected and if the number of the pulse is "0", the first lamp $69_1$ is lighted. If the number of the pulse is not "0", "1" is subtracted from it. Here, if the resultant number of the pulse is "0", the first and the second lamps $69_1$ and $69_2$ are lighted. This means that the differential movement of the point of origin plus one pulse is applied. If the number of the pulses is not "0" again, "1" is further subtracted from it. Here, if the resultant number of the pulse is "0", the first, the second and the third lamps $69_1$, $69_2$ and $69_3$ are lighted. This means that the differential movement of the point of origin plus two pulses is applied. If the number of the pulses is not "0" again, "1" is further subtracted from it. Here, if the resultant number of the pulse is "0", the first, the second, the third and the fourth lamps $69_1$, $69_2$, $69_3$ and $69_4$ are lighted. This means that the differential movement of the point of origin plus three pulses is applied. Here, if the number of the pulses is not "0" again, all the lamps $69_1$–$69_5$ are lighted. This means that the differential movement of the point of origin plus four pulses is applied.

As described above, by subtracting one pulse sequentially from "the present number of the pulses" (angle) it is possible to put instantaneously on or off the lamps in the lighting level of 1–5.

While the above example has been displayed by the number of the pulses, it may be displayed by analog amount. Further, while the above example has been shown in five levels, it may be shown in any other number of levels as required.

INDUSTRIAL APPLICABILITY

As described above, the shirring control apparatus according to the present invention is used with an automatic variable shirring machine and is capable of automatically measuring patterns, calculating the differential movement data in correspondence to the kind of material of the cloth and the cutting angle with respect to the fabric grain line to determined the amount of shirring, and sewing the clothes together in the form close to the idea by the designer.

We claim:

1. In a shirring sewing machine system for sewing a first cloth having a long sewing length divided into a plurality of notch sections on a second cloth having a short sewing length divided into the same number of notch sections as the first cloth with notch positions of each of the first cloth and the second cloths aligned, said system comprising:

a memory means for storing a curve (A) defining an ideal distribution of an amount of shirring;

an input means for inputting at least the length of notch sections of each of the first and second cloths;

a first distribution means for changing the relative coordinates of the ideal distribution curve to real coordinate values in accordance with at least said inputted length of notch sections and for distributing said amount of shirring to each of said notch sections in accordance with said real coordinate values;

a second distribution means for distributing said distributed amount of shirring of each of said notch sections to each stitch in accordance with the number of stitches of each of the notch sections calculated from said length of notch sections of said second cloth and a predetermined feeding pitch for said second cloth; and a means for calculating and storing an amount of differential movement for a cloth feeding unit which supplies the amount of shirring corresponding to said distributed amount of shirring per stitch to said first cloth.

2. In a shirring sewing machine system for sewing a first cloth having a long sewing length divided into a plurality of notch sections on a second cloth having a short sewing length divided in the same number of notch sections as the first cloth with notch positions of each of the first cloth and the second cloths aligned, said system comprising:

a first means for storing a curve (A) defining an ideal distribution of an amount of shirring and a coefficient of bias against texture of said cloths;

a second means for storing sewing data to be made;

a third means for measuring and inputting the length of notch sections of each of said first and second cloths;

a fourth means for calculating an amount of shirring for each of said notch sections in accordance with said length of each of said notch sections of the first and second cloths;

a fifth means for changing the relative coordinates of the ideal distribution curve to real coordinate values in accordance with said inputted length of notch sections of the first and second cloths;

a sixth means for dividing each of the notch sections of the first cloth into a plurality of points and for calculating angles against texture of the first cloth at the divided points from the notch point coordinate value and for calculating and storing a coefficient of bias at the divided points in accordance with said calculated angles;

a seventh means for distributing and storing the amount of shirring to each notch section in accordance with said real coordinate value of the distribution curve;

an eighth means for calculating the number of stitches per notch section from said length of said notch section of said second cloth and a predetermined feed pitch for said second cloth;

a ninth means for calculating and distributing said distributed amount of shirring by said seventh means to each stitch in accordance with said number of stitches;

a tenth means for calculating the amount of differential movement for a cloth feeding unit which supplies the amount of shirring corresponding to said distributed amount of shirring per stitch to said first cloth in accordance with said stored coefficient of bias; and an eleventh means for registering data of the amount of shirring per stitch calculated by said tenth means.

3. The shirring sewing machine system of claim 2, further comprising a sewing machine side control device which includes:

a cloth feeding unit including a seam forming means with a reciprocating sewing needle, and first and second cloth feed means, for automatically adjusting said first and second cloth feed means to change the amount of shirring;

a means for sequentially reading out data from said second means in synchronism with the reciprocating motion of the sewing needle; and means for comparing, when a needle is detected to have come at a lower stop position, the data for the last stitch with the data for the stitch next to the last and moving, when the needle is detected to have come at an upper stop position, the differential shaft to effect shirring.

4. The shirring sewing machine system of claim 2, wherein said input means for inputting the length of notch sections of said first and second cloths comprises a pattern input device including a roller for rotating on the stitch line of said cloths, a pulse generating means for generating pulses corresponding to rotation of the roller, a means for calculating the length corresponding to the number of pulses from said pulse generating means.

5. A method of sewing a seam interconnecting a first cloth having a long sewing length and a second cloth having a short sewing length, said method comprising determining a shirring distribution curve for an ideal seam which is of undetermined length and which has a shirring distribution corresponding to a desired shirring distribution for the seam to be sewn, said step of determining a shirring distribution curve for an ideal seam including determining a shirring distribution curve in which the amount of shirring increases in a continuous manner in a first portion of the ideal seam and decreases in a continuous manner in a second portion of the ideal seam, determining the length of the seam to be sewn, determining the amount of shirring for each stitch of the seam to be sewn as a function of the shirring distribution curve for the ideal seam, and sewing a seam interconnecting the first and second cloths with the amount of shirring for each stitch corresponding to the determined amount of shirring for each stitch of the seam, said step of sewing the seam interconnecting the first and second cloths including sewing a seam in which the shirring increases a continuous manner in a first series of stitches corresponding to the first portion of the ideal seam and decreases in a continuous manner in a second series of stitches corresponding to the second portion of the ideal seam.

6. A method as set forth in claim 5 further including the step of determining data on the easiness of shirring the first cloth, said step of determining the amount of shirring for each stitch of the seam to be sewn including determining the amount of shirring for each stitch of the seam to be sewn as a function of both the shirring distribution curve for the ideal seam and as a function of the data on the easiness of shirring the first cloth.

7. A method as set forth in claim 5 wherein said steps of determining the length of a seam to be sewn and determining the amount of shirring for each stitch of the seam to be sewn includes rolling a roller along stitch lines on the first and second cloths and providing signals indicative of the distance the roller moves along the stitch lines on the first and second cloths.

8. A method as set forth in claim 5 further including the step of determining a coefficient of bias which is a function of the angle at which the first cloth is cut with respect to the fabric grain line of the first cloth, said step of determining the amount of shirring for each stitch of the seam to be sewn including determining the amount of shirring for at least some of the stitches to be sewn as a function of the shirring distribution curve and as a function of the coefficient of bias of the first cloth.

9. A method as set forth in claim 5 further including the step of determining a coefficient of quality which is a function of the quality of the first cloth, said step of determining the amount of shirring for each stitch of the seam to be sewn including determining the amount of shirring for each stitch to be sewn as a function of the shirring distribution and as a function of the coefficient of quality of the first cloth.

* * * * *